US008196267B2

(12) United States Patent
Nalley et al.

(10) Patent No.: US 8,196,267 B2
(45) Date of Patent: Jun. 12, 2012

(54) ASSISTANCE REQUIRED LOCKING CLASP

(75) Inventors: James Elwood Nalley, Corinth, TX (US); Christopher Daniel Buehler, Dallas, TX (US); Bruce Woodall, Plano, TX (US); James Fairey, Frisco, TX (US)

(73) Assignee: TruePosition, Inc., Berwyn, PA (US)

( * ) Notice: Subject to any disclaimer, the term of this patent is extended or adjusted under 35 U.S.C. 154(b) by 263 days.

(21) Appl. No.: 12/616,365

(22) Filed: Nov. 11, 2009

(65) Prior Publication Data

US 2011/0107566 A1 May 12, 2011

(51) Int. Cl.
*A44C 5/24* (2006.01)

(52) U.S. Cl. ..... 24/71 J; 24/265 WS

(58) Field of Classification Search ..... 24/69 R, 24/70 R, 70 SK, 70 ST, 70 J, 69 ST, 69 J, 24/69 SK, 71 R, 71 ST, 71 J, 71 SK, 68 J, 24/265 WS; 224/164, 176
See application file for complete search history.

(56) References Cited

U.S. PATENT DOCUMENTS

| | | | | |
|---|---|---|---|---|
| 1,612,395 | A | | 12/1926 | Osborne |
| 2,028,791 | A | | 1/1935 | Lynds |
| 4,380,097 | A | | 4/1983 | Keifer |
| 4,424,611 | A | * | 1/1984 | Mori ..... 24/192 |
| 4,545,094 | A | | 10/1985 | Fontana |
| 4,667,378 | A | | 5/1987 | Sturm |
| 5,175,912 | A | | 1/1993 | Chevalley et al. |
| 5,179,733 | A | | 1/1993 | Matsui |
| 5,522,529 | A | | 6/1996 | Yurman et al. |
| 6,191,692 | B1 | | 2/2001 | Stoltz et al. |
| 6,308,382 | B1 | | 10/2001 | Takahashi et al. |
| 2007/0182548 | A1 | | 8/2007 | Raad |

OTHER PUBLICATIONS

Buehler, C. et al., Memorandum for Record Re: Summary of Tests on Jan. 13, 2009, EmFinders Test with Plano 911 & Police, Jan. 13, 2009, 6 pages.

* cited by examiner

*Primary Examiner* — James Brittain
(74) *Attorney, Agent, or Firm* — Woodcock Washburn LLP

(57) ABSTRACT

A locking clasp provides security against opening without assistance to ensure that items employing the clasp remain locked and affixed in place. In addition, the locking clasp is easy to lock, aesthetically unobtrusive, and comfortable to wear.

17 Claims, 12 Drawing Sheets

415
414
409
408
410
413
415
414
409

415
414
412
411
409
411
412
413
408
415
414
410
416

408
415
414
413
409
410

ASSISTANCE REQUIRED LOCKING CLASP

TECHNICAL FIELD

The subject matter disclosed herein relates generally to a locking clasp used to secure two ends of a flexible, adjustable loop, and more particularly to a locking clasp for wrist mounted tagging or telemetry devices that require assistance for the wearer to remove.

BACKGROUND

Clasps for jewelry are well known. Necklaces, bracelets, and even anklets have long used clasps to secure the loose ends of the jewelry to form an endless loop. Locking clasps generally innovate in terms of locking security, aesthetics, and ease of use. Non-bi-fold jewelry locking clasps have been developed, such as those detailed in U.S. Pat. No. 1,612,395 to Osborne, U.S. Pat. No. 2,028,791 to Lynds, U.S. Pat. No. 4,667,378 to Sturm, and U.S. Pat. No. 5,522,529 to Yurman et al. Other non-bi fold locking clasps for affixing of identification or marking tags have been developed to prevent removal without disfigurement or destruction of the tag, such as those detailed in U.S. Pat. No. 4,380,097 to Keifer, and U.S. Pat. No. 6,191,692 to Stoltz et al.

Some bi-fold clasps have been developed for jewelry in an attempt to secure the clasp. U.S. Pat. No. 4,545,094 to Fontana depicts the use of a hook for securing a clasp. However, Fontana's hook does not provide triple locking functionality and would not be comfortable to wear as the hook extends down below the band into the wrist of the wearer. U.S. Pat. No. 6,308,382 to Takahashi et al depicts a bi-fold clasp which is secured through use of screws. Takahashi's screw-based clasp does not provide the functionality of the present invention which allows for ease of locking and aesthetic unobtrusiveness.

Although the above patents show various locking clasp mechanisms for jewelry and other purposes, none describes the features or functionality that provides the innovation of the present invention.

SUMMARY

A primary goal of the present invention is to provide a locking clasp that provides security against opening without assistance to ensure that items employing the clasp remain locked and affixed in place. In addition, the locking clasp is intended to be easy to lock, aesthetically unobtrusive, and comfortable to wear.

BRIEF DESCRIPTION OF THE DRAWINGS

The foregoing summary as well as the following detailed description are better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF ILLUSTRATIVE EMBODIMENTS

Described herein are illustrative embodiments of the present invention. While these illustrative embodiments aid in the description of the present invention, these embodiments are not intended to limit the scope of the invention in any way.

Figure 1:
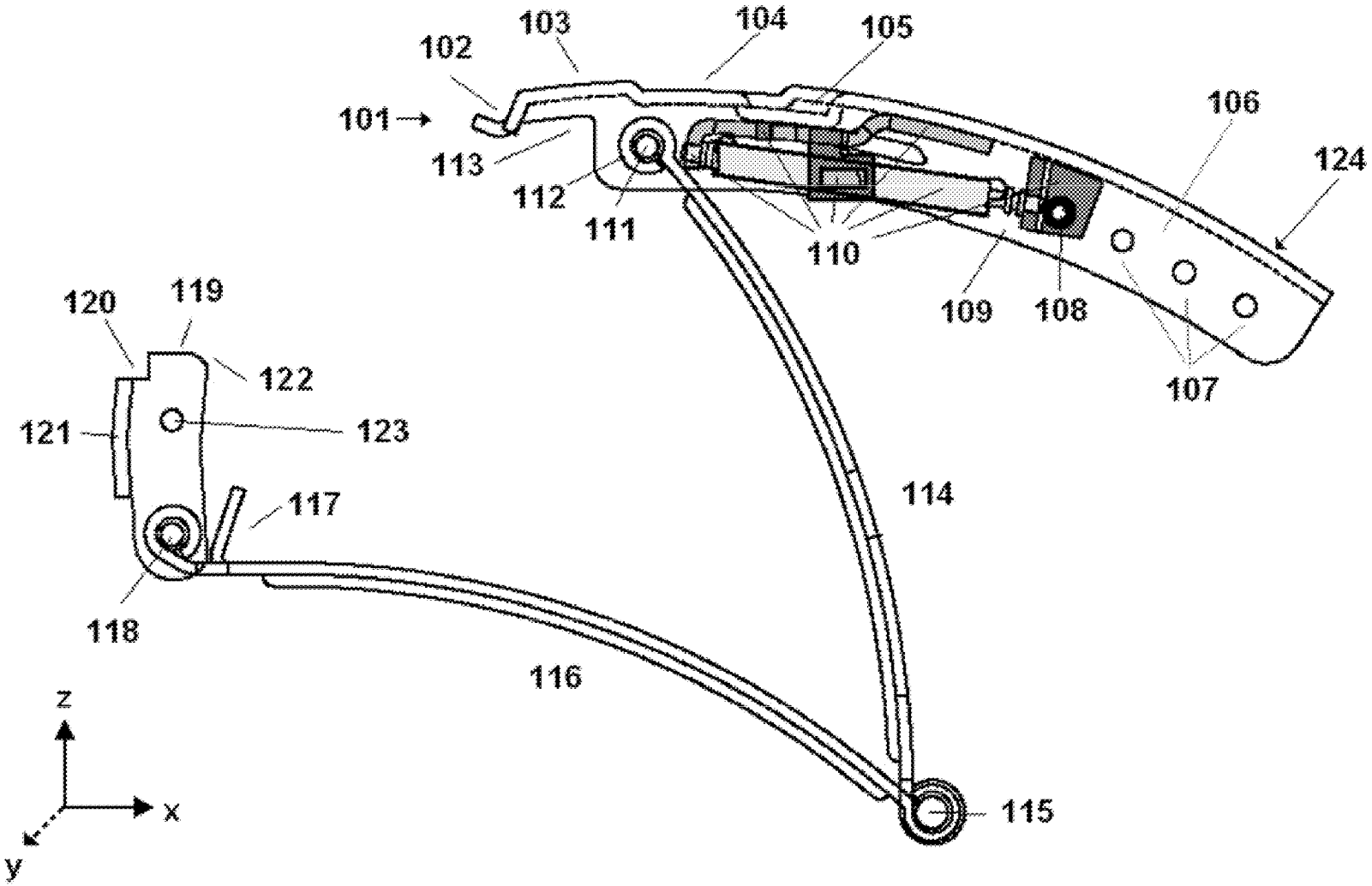
FIG. 1 depicts a sectional side view of the bi-fold triple locking clasp.

FIG. 1 shows a sectional side view of the bi-fold triple locking clasp 100, which omits the near side wall 109 of can assembly 101. Can assembly 101 includes can 106 and internal latching mechanism 110. The clasp 100 includes a can assembly 101, a short leaf 114, a long leaf 116, and a safety latch 119. Can assembly 101 is rotatably attached to one end of short leaf 114 via hinge 111. The end of short leaf 114 near hinge 111 is formed into a friction element 112 to secure short leaf 114 to hinge 111. Hinge 111 may be any kind of hinge, such as a spring pin.

The other end of short leaf 114 is rotatably attached to one end of long leaf 116 via hinge 115. Hinge 115 may be any kind of hinge, such as a rivet pin. The other end of long leaf 116 is rotatably attached to clasp latch 119 via hinge 118. Hinge 118 may be rotatably connected to an end of a band (not shown), such as a watch band. Part of long leaf 116 near hinge 118 is formed into a claw hook 117. When clasp 100 is folded into a closed position, claw hook 117 engages friction element 112 to aid in securing clasp 100 in a closed position. The interconnection between claw hook 117 and friction element 112 forms a first locking mechanism of the clasp 100.

Long leaf 116 and short leaf 114 are formed in a curved configuration. In one embodiment, long leaf 116 and short leaf 114 are formed of a bendable, corrosion-resistant material such as a spring stainless steel alloy. These characteristics allow elements, such as claw hook 117 and friction element 112 to have an interference fit without being damaged when clasp 100 is closed.

Safety latch 119 is comprised of a corrosion-resistant material such as a stainless steel alloy. Safety latch 119 has a crossbar 121 between two side walls 122. Side walls 122 have a friction point 123 on the inside surface of the walls 109. Safety latch 119 is configured so that, after claw hook 117 engages with friction element 112, safety latch 119 may rotate down on top of can assembly 101. When safety latch 119 is in a locked position, crossbar 121 rests inside of a fitted indentation 104 on can assembly 101. While in this position, friction points 123 engage port holes on the side walls 109 of can assembly 101. The engaging of friction points 123 and port holes on the side walls 109 of can assembly 101 forms a second locking mechanism of the clasp 100.

Can 106 is comprised of a corrosion-resistant material such as a stainless steel alloy. A number of anchor ports 107 are located on the side walls 109 at the free end 124 of can 106 of can assembly 101. Anchor ports 107 provide a number of location where the band (not shown), such as a watch band, may connect to can assembly 101 via a spring pin. The free end 124 of can 106 fits over and covers a portion of the band when the clasp 100 is in a closed position. Can 106 also provides a distinct anchor ports 108 in side walls 109 for attachment of an internal latching mechanism 110.

Can shell 106 has a lift bar 102 to facilitate the disengagement of the first locking mechanism. A first curved surface 103 of can shell 106 fits behind the crossbar 121 of the safety latch 119 when the safety latch 119 is a locked position. When safety latch 119 is in a locked position, semicircular indention 105 in can assembly 101 provides access for lifting the crossbar 121 from its locked position within the depression formed by the fitted indentation 104 in an unlocking process. The curved surface 124 at the free end of can shell 106 anchors the rigidly parallel side walls 109 of can assembly 101, and covers the internals of the clasp mechanism 110. The curved surface 124 at the free end of can shell 106 also provides surface area for inscriptions, ornamentation or medical alert information.

Figure 2A:
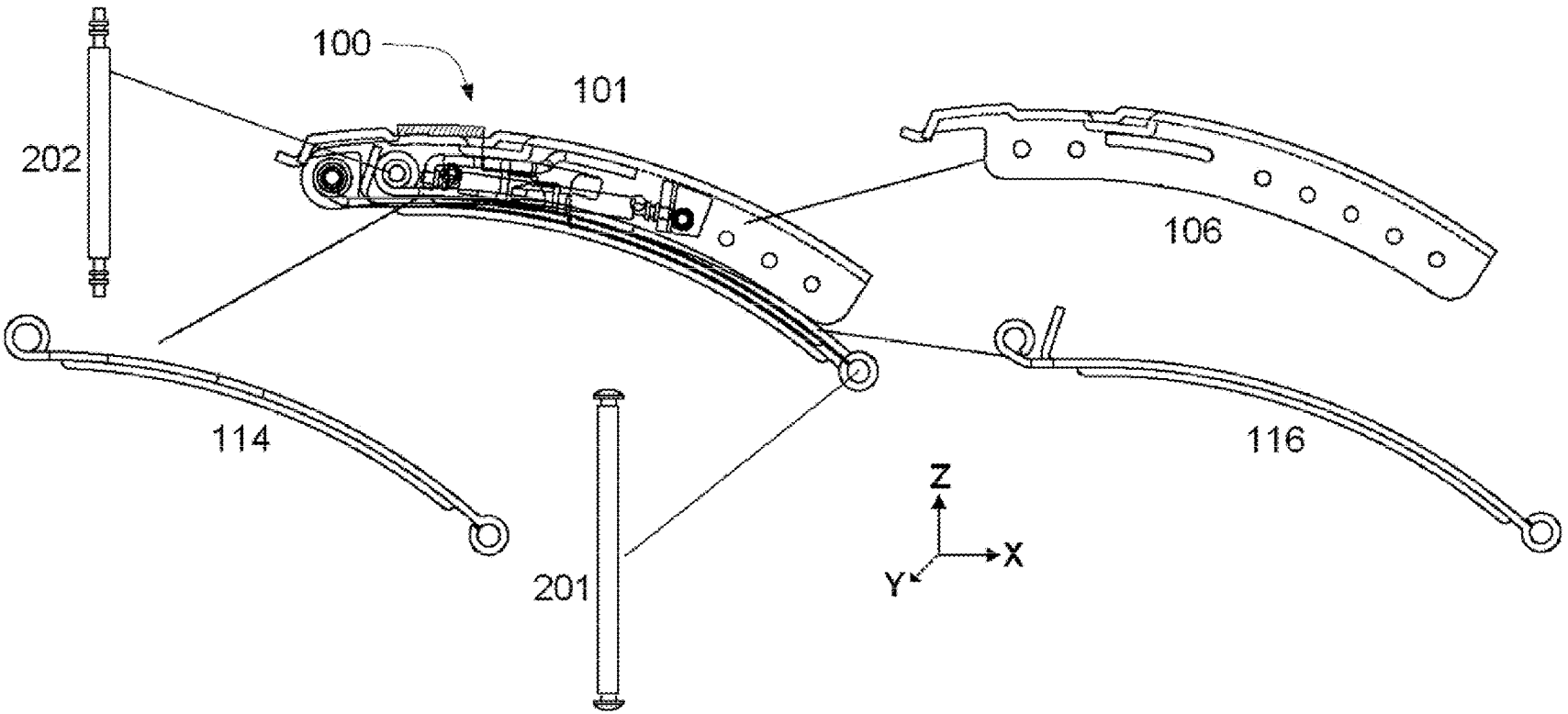
FIG. 2A depicts a side view of the bi-fold triple locking clasp in a folded position, indicating where a number of components are located.

FIG. 2A shows a sectional side view of the bi-fold triple locking clasp 100 in a closed and locked position, where the sectional view omits the near side wall 109 of can assembly 101. The parts shown include can shell 106, short leaf 114, rivet pin 201, long leaf 116, and spring pin 202. These parts are preferably constructed from corrosion-resistant material such as a stainless steel alloy.

As previously mentioned, hinge 115 and hinge 111 may be any type of hinge. In the embodiment depicted by FIG. 2A, a rivet pin 201 is used to provide hinge 115 and a spring pin 202 is used to provide hinge 111.

Figure 2B:
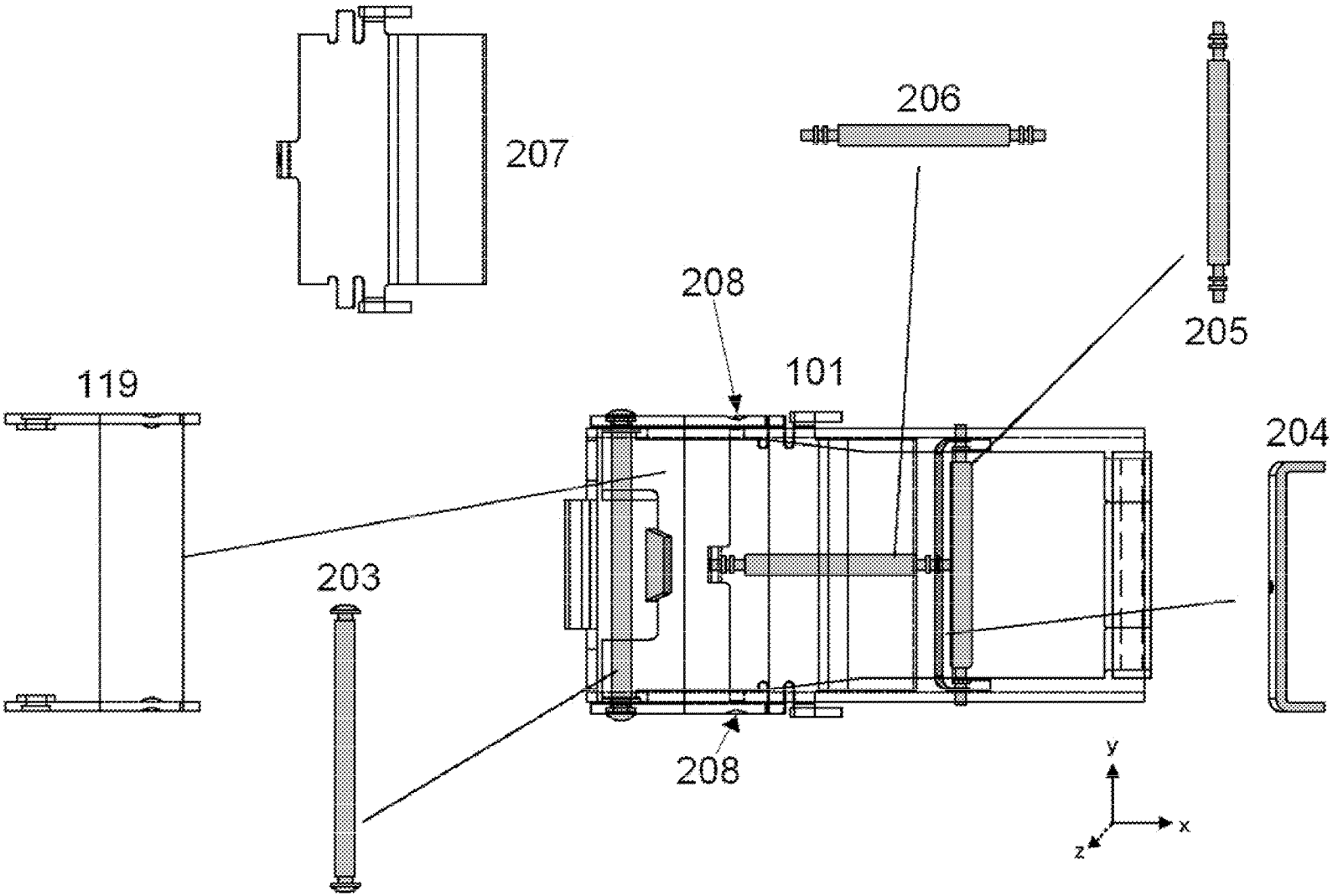
FIG. 2B depicts a bottom view of the bi-fold triple locking clasp in a folded position, indicating where a number of components are located.

FIG. 2B shows a sectional side view of the bi-fold triple locking clasp 100 in a closed and locked position from the top of clasp assembly 101, where the sectional view omits the near top side of the can shell 106. The sectional view in FIG. 2B depicts a view of the internal latching mechanism 110 of can assembly 101. The parts of internal latching mechanism 110 depicted in FIG. 2B include pivot bar 204, spring pins 205 and 206, and slider 207. The sectional view in FIG. 2B also depicts safety latch mechanism 119 in a locked position.

In the embodiment depicted in FIG. 2B, rivet pin 203 is used to provide hinge 118, rotatably connecting long leaf 116 to safety latch 119 and to the first end of the band (not shown). The depiction in FIG. 2B shows safety latch 119 in the locked position. Here, friction points 123 are shown engaged to safety latch indentations 208 in side walls 109 of can shell 106. The engaging of friction points 123 and indentations 208 on the side walls 109 of can assembly 101 forms a second locking mechanism of the clasp 100.

Figure 3A:
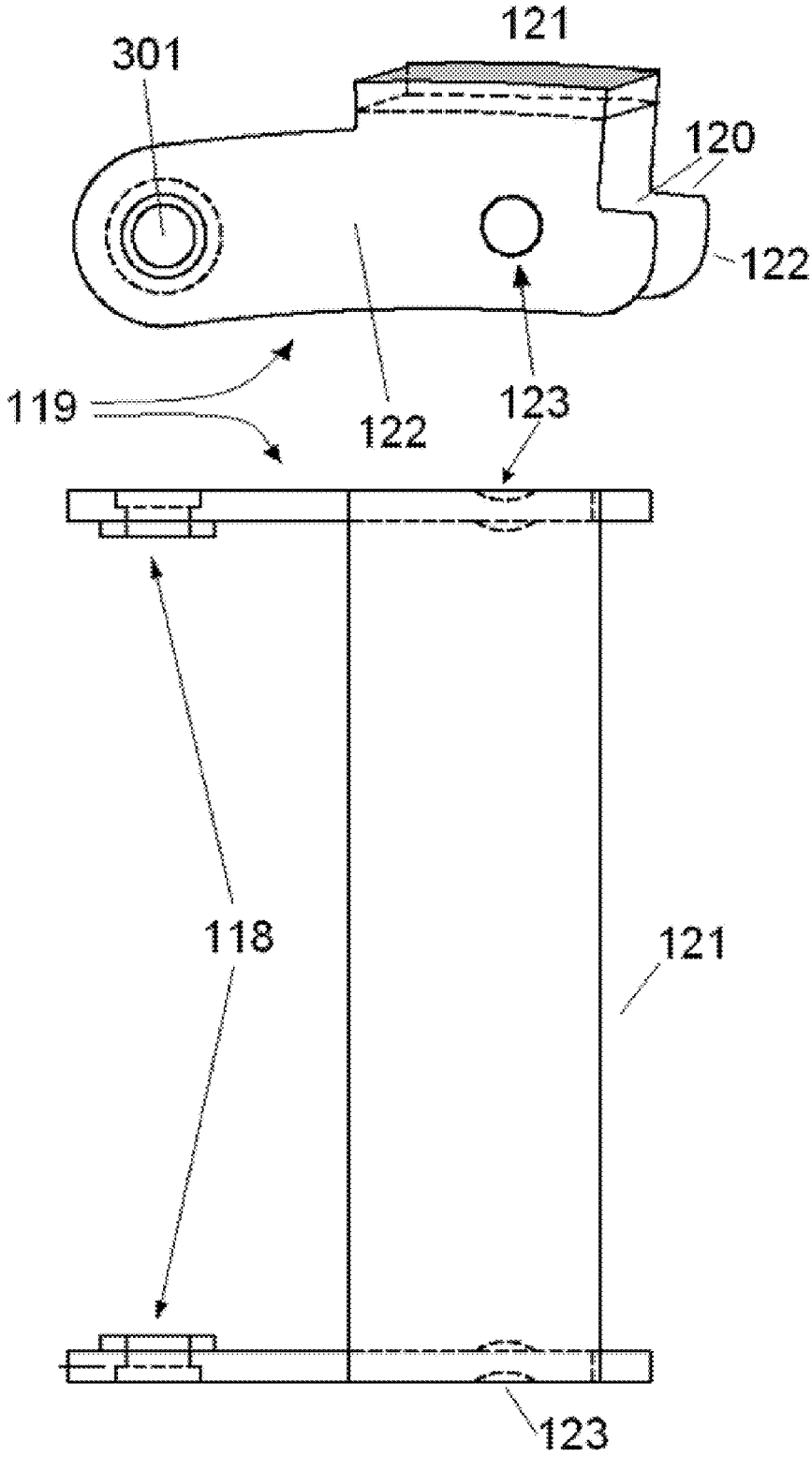
FIG. 3A depicts a top view and a perspective view of a safety latch.

FIG. 3A depicts two views of safety latch 119, one view depicting a top view and the other depicting a perspective view. Safety latch 119 includes a ventral cross member 121 interconnecting two side pieces 122. The ventral cross member 121 serves both to hold the two side pieces 122 rigidly in parallel and as a handle for disengaging the second locking mechanism when bi-fold triple locking clasp 100 is in a folded, locked position. The side pieces 122 provide a friction point 123 on the interior of each side piece 122 underneath the ventral cross member 121 and a hinge holes 301 for insertion of a hinge mechanism, such as a rivet pin or a spring pin. Hinge holes 301 and hinge mechanism (not shown) allow for rotatably connecting safety latch 119 to a band (not shown) and a long leaf (not shown). The end of the side walls 122 which are furthest from hinge holes 301 include a latching hook surface 120 on each side wall 122. This latching hook surface is part of a third locking mechanism which will be described below.

Figure 3B:
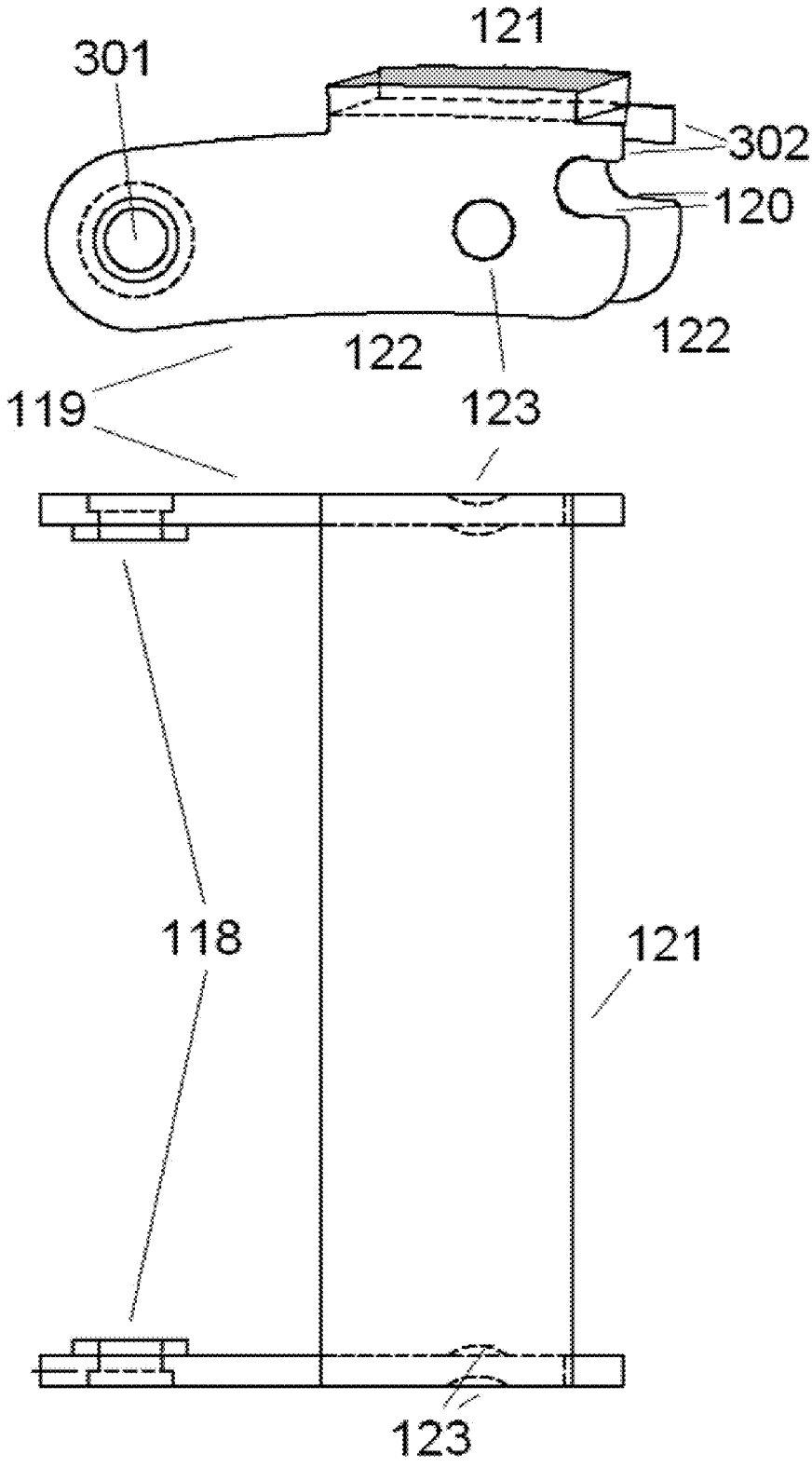
FIG. 3B depicts an alternative top view and a perspective view of a safety latch.

FIG. 3B depicts two views of and alternative embodiment of the safety latch 119, one view depicting a top view and the other depicting a perspective view. Safety latch 119 includes a ventral cross member 121 interconnecting two side pieces 122. The ventral cross member 121 serves both to hold the two side pieces 122 rigidly in parallel and as a handle for disengaging the second locking mechanism when bi-fold triple locking clasp 100 is in a folded, locked position. The side pieces 122 provide a friction point 123 on the interior of each side piece 122 underneath the ventral cross member 121 and a hinge holes 301 for insertion of a hinge mechanism, such as a rivet pin or a spring pin. Hinge holes 301 and hinge mechanism (not shown) allow for rotatably connecting safety latch 119 to a band (not shown) and a long leaf (not shown). The end of the side walls 122 which are furthest from hinge holes 301 include a non-latching hook surface 302 on each side wall 122 that serves to surround the locking tab (not shown) without extending the crossbar 121. The end of the side walls 122 which are furthest from hinge holes 301 include a latching hook surface 120 on each side wall 122. This latching hook surface 120 is part of a third locking mechanism which will be described below.

Figure 4B:
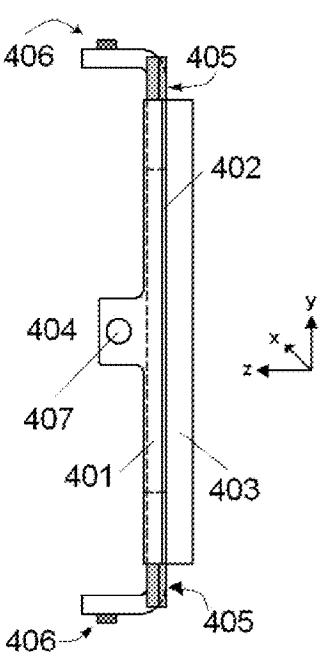
FIGS. 4A, 4B, and 4C depict a bottom view, a frontal view, and a side view of a slider component.
Figure 4A:
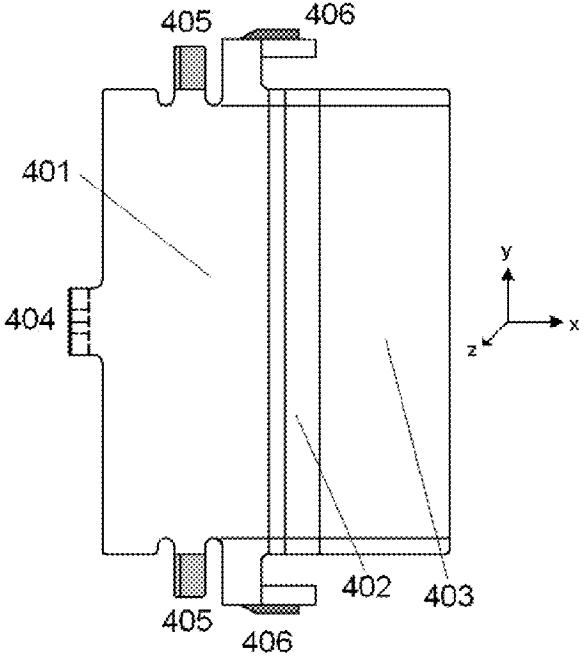
Figure 4C:
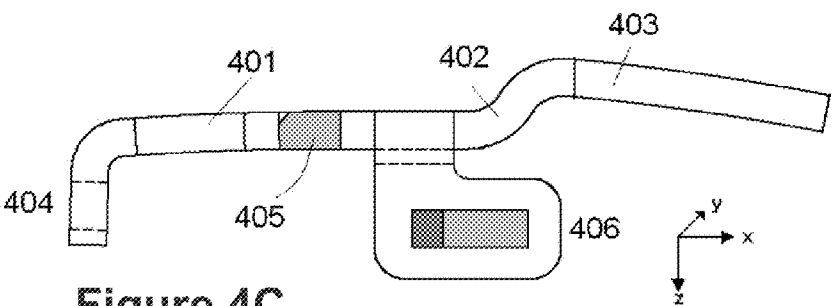

FIGS. 4A, 4B, and 4C each depict a different view of slider 207. Slider 207 may be composed of a durable, corrosion-resistant material such as a stainless steel alloy. Using a stainless steel alloy, the slider 207 depicted in FIGS. 4A, 4B, and 4C may be stamp formed of a single piece of stainless steel alloy sheet. Each of the descriptions of FIGS. 4A, 4B, and 4C below is described in terms of slider 207 being stamp formed.

FIG. 4A depicts a view from the bottom side of slider 207. Slider 207 comprises a first flat section 401, a transverse bent section 402, and a second flat section 403. The curved nature of slider 207 section allows for both clearance of other parts in clasp 100 and a snug fit with can shell 106 (not shown in FIG. 4A). Slider 207 also includes tab 404, flanges 405, and lateral tabs 406, each of which protrudes from first flat section 401.

FIG. 4B depicts a view from the front side of slider 207. FIG. 4B depicts flanges 403 protruding directly out of first flat section 401, whereas lateral flanges 406 are bent towards the bottom of slider 207 after protruding from first flat section 401. Similar to lateral flanges 406, FIG. 4B also depicts tab 404 protruding from first flat section 401 and being bent towards the bottom of slider 207 after protruding from first flat section 401. An attachment hole 407 is located on the bend section of tab 404. Referring back to FIG. 2B, when spring pin 206 is inserted into attachment hole 405 of tab 404, the spring pin 206 may push the entire slider 207 away from pivot bar 205.

FIG. 4C depicts a side view of slider 207. In this view, the bends in tab 404 and lateral flanges 406 are further depicted. FIG. 4C also depicts an embodiment of the lateral flanges 406. Lateral flanges 406 are intended to allow a user place two fingers around the flanges and to pull the entire slider backward, against the force exerted by spring pin 206 in the embodiment shown in FIG. 2B. In the embodiment shown in FIG. 4C, the width of the main portion of lateral flanges 406 is greater than the width of the portion of lateral flanges 406 which are attached to first flat section 401. This embodiment allows for a greater surface area of the main portion of lateral flanges 406 in order to give the user more area to grasp.

Figures 4D, 4E, 4F:
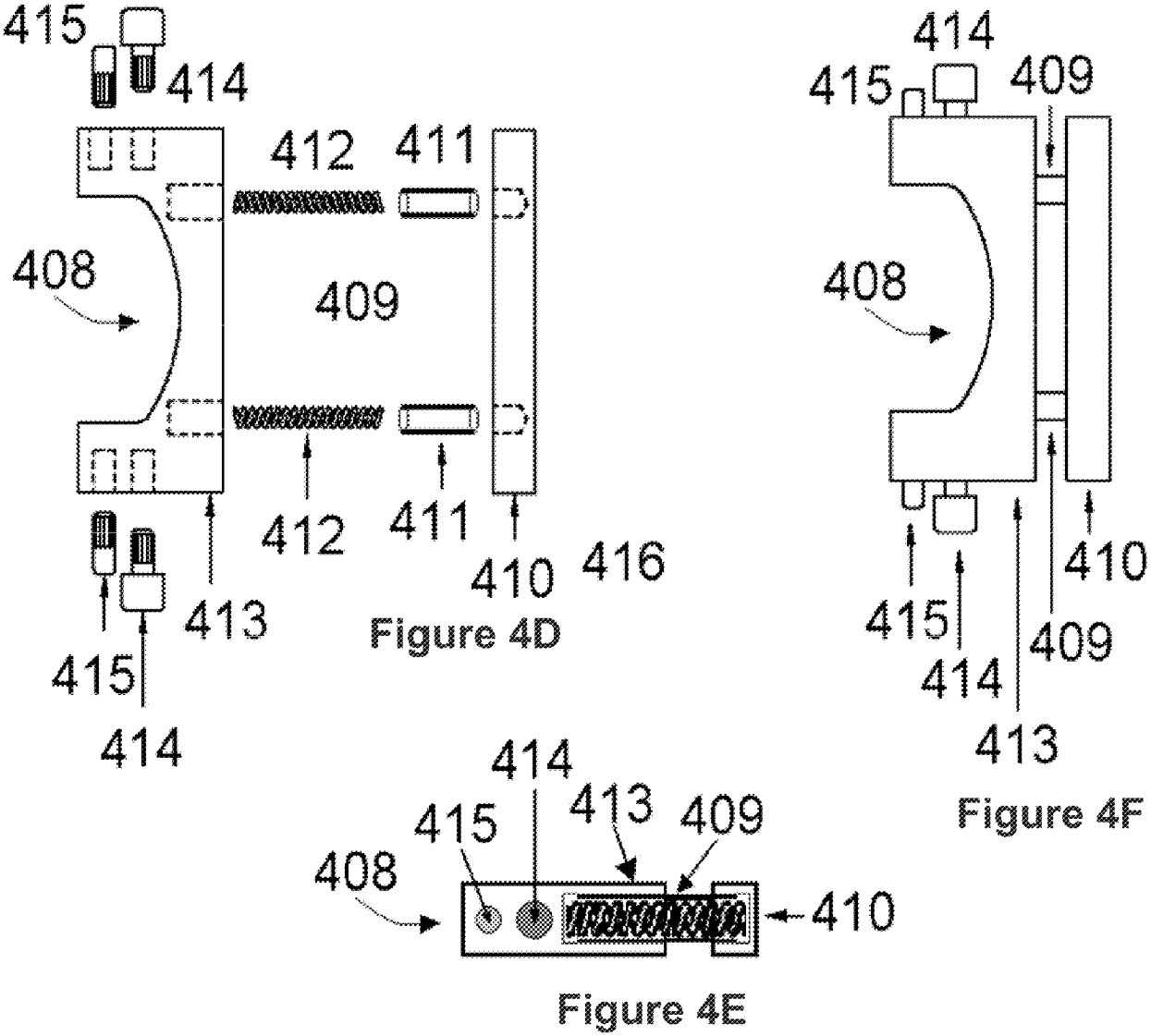
FIGS. 4D, 4E, and 4F depict a bottom view, a frontal view, and a side view of alternative embodiment of a slider component.

FIGS. 4D, 4E, and 4F depict an alternative embodiment of the slider and sliding mechanism. In this embodiment, the alternative Slider mechanism 408 can be composed of a durable, corrosion-resistant material such as a stainless steel alloy. In the alternative slider design shown in 4D, 4E, and 4F, the components are individually machined from a non-flexible material, such as a stainless steel alloy. This alternative mechanism slider 408 design provides identical functionality sheet to the previously depicted slider 207 with improved aesthetics at a higher manufacturing cost.

FIG. 4D depicts a view from the bottom side of slider plate 408 and associated mechanisms prior to assembly. The Slider mechanism 408 comprises a first flat plate section 413, an encased spring section 409, and an anchor bar 410. The encased spring section 409 is formed of a spring 412 which fits inside a hollow tube 411. The spring 412 is friction anchored in recessing drilled into both the slider plate 413 and the anchor bar 410. The encased spring section 409 allows for both clearance of other parts in clasp 100 and a snug fit with the curved can shell 106 (not shown in FIG. 4D). The Slider plate 413 has recesses drilled into either side for the addition of the locking pins 415 and the pullback pins 414 (the locking pins are functionally equivalent to the previously described flanges 405 while the pullback pins 414 are functionally equivalent to the previously described lateral tabs 406). The locking pins 415 and pullback pins 414 are cylindrical in nature and are press fit or screwed into the recesses provided in the slider plate 413.

FIG. 4E depicts a top view of the assembled alternative slider mechanism 408 in compressed form. The compressed form shown is encountered during the locking and unlocking action provided by the clasp 100. In the assembled, compressed form, the alternative slider mechanism 408 has the slider plate 413 pulled by the pullback pins 414 toward the anchor bar 410 which is affixed to the can shell 106 of the can assembly 101. While the alternative slider mechanism 408 is compressed, the encased spring section 409 fits into the recesses provided in the slider plate 413 and anchor bar 410. The springs 412 are completely enclosed by the hollow tube 411. In this compressed form, the locking pins 415 are no longer in contact with the locking clasp 119.

FIG. 4F depicts a side view of the alternative slider mechanism 408. In this view, the alternative slider mechanism is portrayed as compressed as when the clasp 100 is in the process of locking or unlocking. In this view, the locking pins 415 and pullback pins 414 are shown to be cylindrical in nature and the relative positioning of the pin on the slider plate 413 is shown. The encased spring section 409 is depicted in cut-away form as to show the anchor points of for the spring as recessed into the slider plate 413 and anchor bar 410.

Figure 5B:
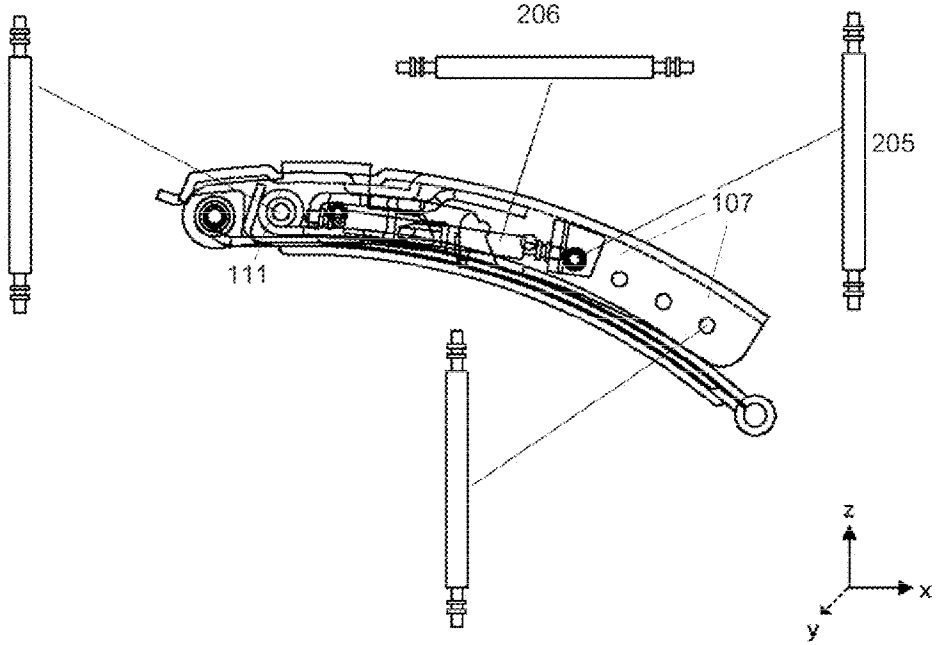
FIG. 5B depicts a side view of the bi-fold triple locking clasp in a folded position, indicating placement of the spring pins in the clasp.
Figure 5A:
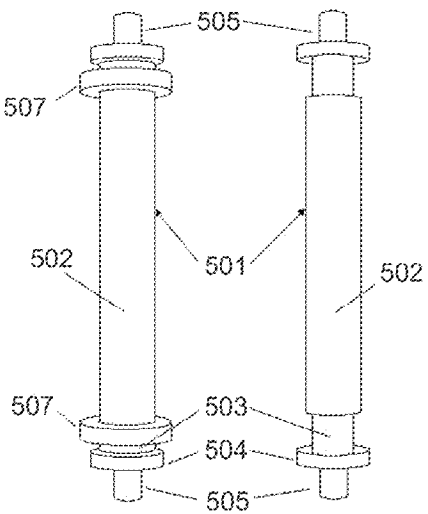
FIG. 5A depicts possible spring pin configurations.

FIGS. 5A and 5B depict various spring pin types and possible placement of spring pins in claps 100, respectively. FIG. 5A depicts prominent examples of commercially available spring pins, which are used in allowing for easy resizing and replacement of bands, such as watchbands. FIG. 5A depicts two types of spring pins 501 which are cylindrical telescoping spring pins. Each spring pin 501 includes cylindrical spring-loaded pipes 502 and 503, flanges 504, and tipped ends 505. Spring pins 501 may also include a second flange 508 near each flange 504 to provided added stability and support.

FIG. 5B depicts several of the location where spring pins 501 may be placed in clasp 101. These locations include hinge 111, between anchor ports 107, as spring pins 205, and as spring pin 206.

Figure 6A:
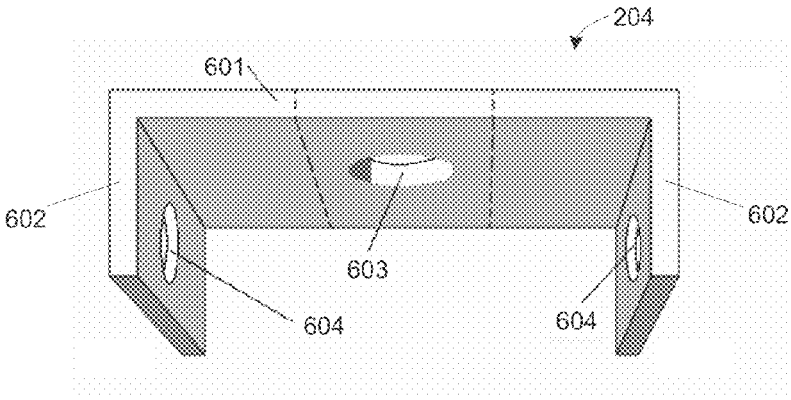
FIGS. 6A, 6B, and 6C depict perspective views of a pivot bar.
Figure 6B:
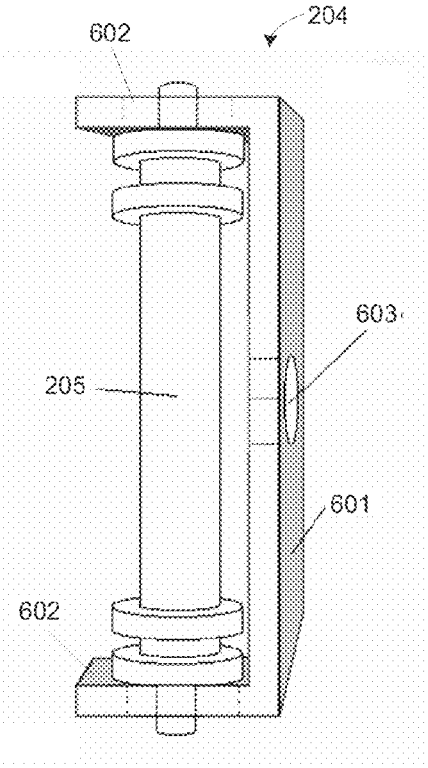
Figure 6C:
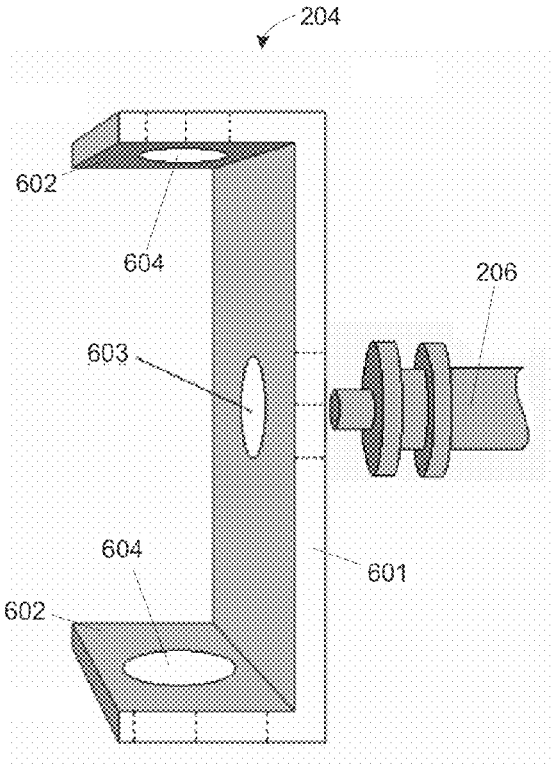

FIGS. 6A, 6B, and 6C depict perspective views of pivot bar 204. In one embodiment, pivot bar 204 is stamp formed from a single piece of a durable, corrosion-resistant material such as a stainless steel alloy. The three sections of the pivot bar 204 include cross piece 601 and parallel side walls 602. The length, height, width and thickness of the pivot bar 204 are designed to fit within can shell 106 and to enclose spring ping 205. Cross piece 602 is punctured with a centered through-hole 603 for securing spring pin 206. Side walls 602 each have a centered through-hole 604 for fitting of the transverse spring ping 205. FIG. 6A depicts pivot bar 204 alone. FIG. 6B depicts pivot bar 204 enclosing spring ping 205. FIG. 6C depicts pivot bar 204 and the positioning of spring pin 206. When both spring pins 205 and 206 are in place, pivot bar 204 keeps the axis of spring pin 206 perpendicular to and in line with the axis of spring pin 205.

Figure 7:
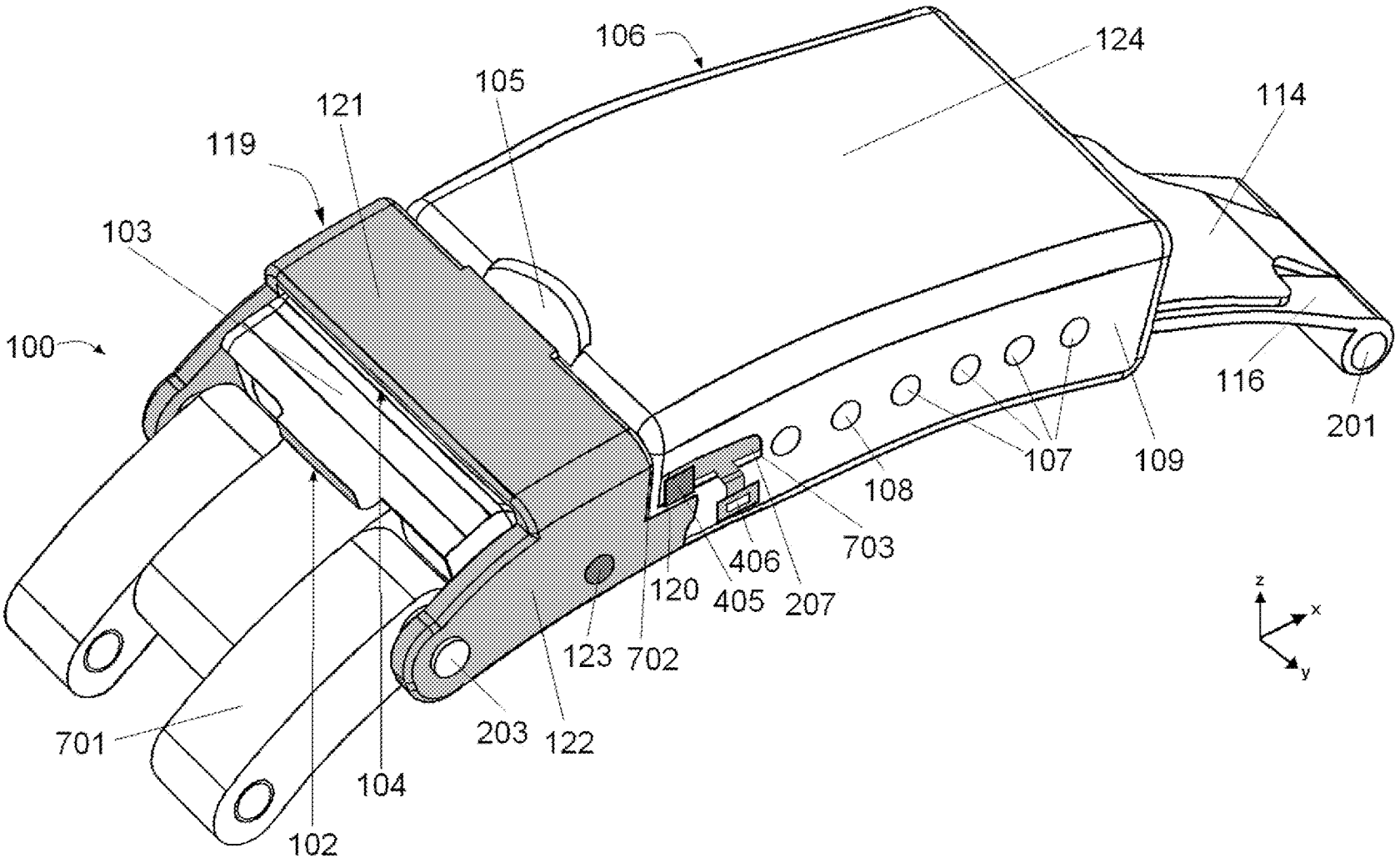
FIG. 7 depicts a perspective view of the bi-fold triple locking clasp in a folded and locked position.

FIG. 7 depicts a perspective view of clasp 100 in a closed and fully-locked position, illustrating each of three locking mechanisms. The first and second locking mechanisms have been described previously. The third locking mechanism involves slider 207 and safety latch 119. When safety latch 119 is closed to the position shown in FIG. 7, side walls 122 of safety latch 119 come into contact with flanges 405 of slider 207. After coming into contact with flanges 405, as safety latch 119 is pushed down, slider 207 retracts away from safety latch 119. This contracts spring pin 206 as slider 207 retracts. One safety latch 119 is nears its fully closed position, latch hook surfaces 120 of safety latch 119 lower below flanges 405. Spring pin 206 (not visible in FIG. 7) extends slider 207 so until flanges 403 reach latching cutout 702, the position depicted in FIG. 7. Once flanges 403 are in this position, flanges 405 interfere with safety latch being lifted to disengage the second locking mechanism. This position is the locking position for the third locking mechanism. The third locking mechanism prevents disengagement of the second locking mechanism (safety latch 119); and, the second locking mechanism prevents disengagement of the first locking mechanism (claw hook 117).

The second band end (not shown) is joined to the Can shell 106 via a spring pin (also not shown) which fits into one of the pair of opposing adjustment fittings 107 in the parallel sides 109 of the can 106. Both parallel sides 109 of the can shell 106 also feature the retraction cut-out channel 703 wherein the slider 207 is moved using pull tab 406 is moved to actuate the locking flange 405.

To disengage the third locking mechanism, a user may grasp lateral tabs 406 between two fingers and retract slider 207 until flanges 403 are clear of latch hook surfaces 120. Simultaneously, the user must lift safety latch 119 to disengage the second locking mechanism. Once safety latch 119 is lifted, lateral tabs 406 may be released, allowing slider 207 to extend back in place. Can 106 includes refraction cutouts 103 on each side of side walls 109 so that a user may retract lateral tabs 406. The act of retracting lateral tabs 406 and simultaneously lifting safety latch 119 is intended to be difficult for one who is wearing the clasp as part of an arm band. Typically, the effort required to retract lateral tabs 406 will require one hand and a second hand will be required to lift safety latch 119. Thus, a user wearing clasp 100 on the wrist will not likely be able to disengage the second and third mechanism without assistance from another person.

Once safety latch 119 is lifted and the second and third locking mechanisms are disengaged, the first locking mechanism may be released by lifting lift bar 102. Lifting lift bar 102 uncompresses long leaf 116 and disengages the claw hook 107 (not visible in FIG. 7), allowing the entire clasp 100 to unfold.

Figure 8A:
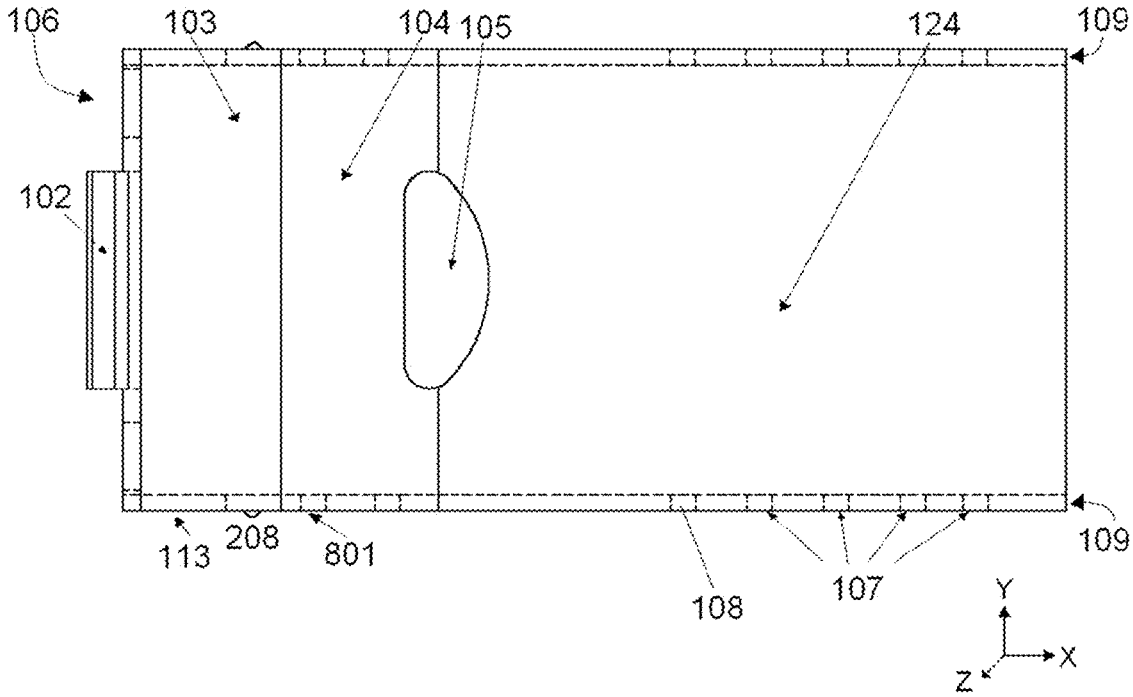
FIGS. 8A and 8B depict a top view and a side view of a can.
Figure 8B:
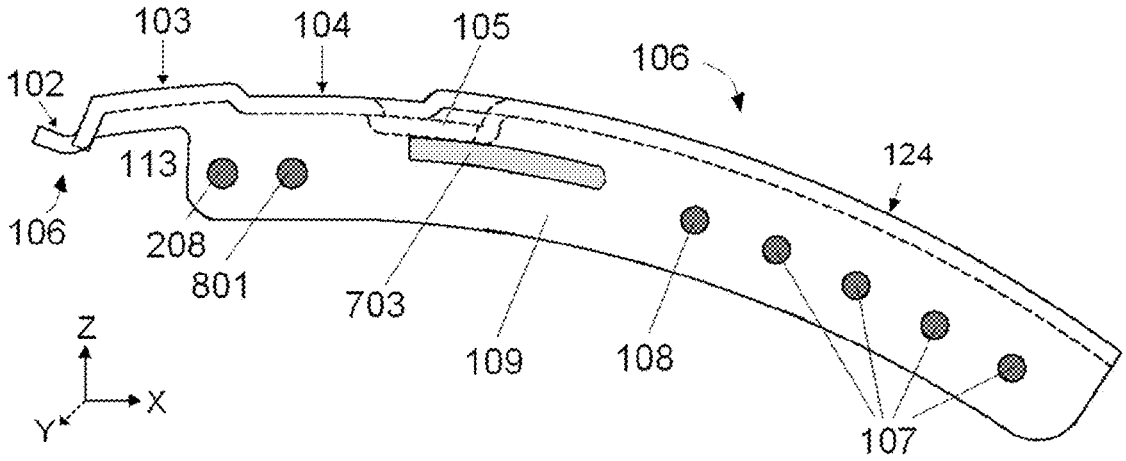

FIGS. 8A and 8B depict details of can shell 106 by a top view and a side view, respectively. FIG. 8A depicts the top surface of can shell 106, including a series of curved planes.

The first plane 103 connects the lift bar 102 to the fitted indentation 104 wherein the cross bar of the safety latch (not shown in FIGS. 8A and 8B) is contained when the clasp is closed. On the opposite side of the fitted indentation 104 from the first plane 103 is the semi-circular indentation 105 for the application of leverage to the cross bar of the safety latch. The semi-circular indentation 105 is indented more deeply than the fitted indentation 104. The main plane 124 of the can shell 106 completes the top surface of the can shell 106 providing cover for the internal mechanism of the clasp as well as for the adjustable connection point of the second end of the attached band (not shown).

FIG. 8B depicts one side wall 109 of can 106; however, both sidewalls 109 may have identical features. Can 106 a lift bar 102 near sidewall cutouts 113. A first through-hole in each side wall 801 allows a hinge 111 to be secured to 106 in order to rotatably secure short leaf 114 (not shown in FIG. 8B). A friction point 208 is provided on each sidewall to fit the corresponding friction points in the safety latch (not shown in FIG. 8B). The sidewall of can 106 contains a cut-out section 703 with channel 802. The cutout allows installation of the slider 207 (not shown in FIG. 8B) plate into the can 106. The channel 802 allows flanges 403 and lateral tabs 406 of slider 207 to extend beyond the side walls 119 of the can 106. Channel 802 may also aid in guiding flanges 403 as they are extended and refracted. Each sidewall has a second through-hole in each side wall 108 for attachment of pivot bar 205 (n not shown in FIG. 8B). Additionally, each sidewall also has a series of through-holes 107 for resizeable attachment of an end of a band, such as a watch band, to the can 801.

Figures 9A, 9B:
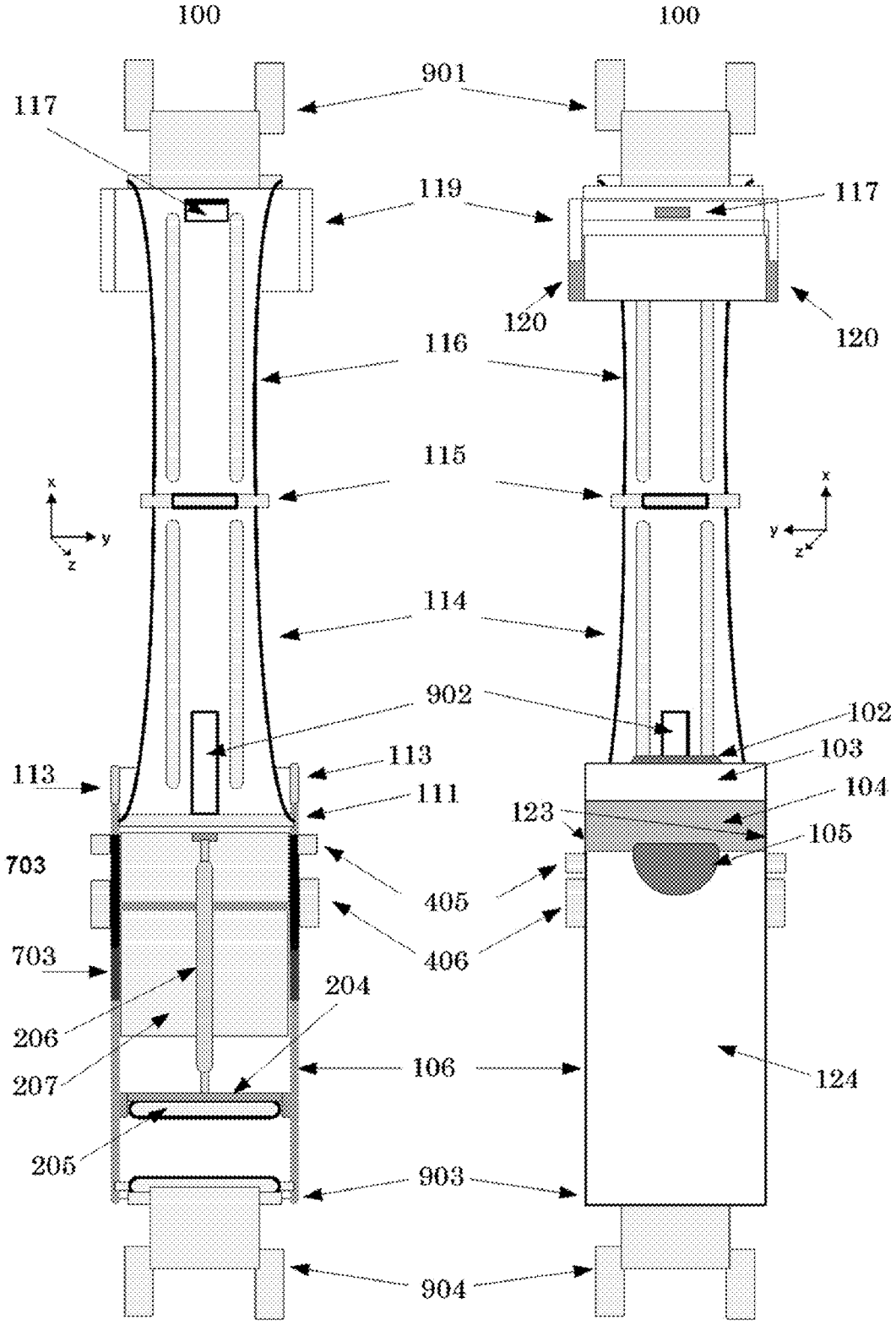
FIGS. 9A and 9B depict a bottom view and a top view of the opened clasp in an opened and fully-extended position.

FIGS. 9A and 9B depict bi-fold triple locking clasp 100 fully open from the bottom (inward) side and the top (outward) side, respectively. A first end of a band 901 is rotatably connected via hinge 118 to safety latch 119 and long leaf 116. The end of long leaf 116 closer to hinge 118 also contains the claw hook 117 which is part of the first locking mechanism. Long leaf 116 is rotatably connected via hinge 115 to short leaf 114. Short leaf 114 contains cutouts 902 which allow free movement of the internal mechanisms of the clasp. Short leaf 114 is rotatably connected to can shell 106 via hinge 111. As seen in FIG. 9A, parallel sides 119 of can shell 106 include cutouts 113 to accommodate first band end 901 when the clasp 100 is in a closed position. As depicted, hinge 111 is provided by a spring pin affixed via holes in the side walls 119 of can shell 106.

Held inside can shell 106 is slider 207. Slider 207 is pushed toward hinge 111 by spring pin 206. Spring pin 206 is connected to a tab 404 at one end of slider 207 and connected to pivot bar 204. Projecting through the channel 703, cut through the side walls 119 of the can shell 106, flanges 405 and lateral tabs 406 allow compression of the spring pin 206 toward the spring pin 205. Pivot bar 204 is held in place perpendicular to the parallel side walls 119 of the can 206 by spring pin 205.

Can shell 106 is attached to a second end 904 of the band by a spring pin. Can shell 106 has a number of anchor ports 107 in side walls 119 which allow the band to be resized by adjusting the anchor port 107 to which spring pin is attached.

FIG. 9B depicts some features of the bi-fold triple locking clasp 100 which are not visible in FIG. 9A. Latching hook surface 120 of safety latch 119 is visible from the top view of FIG. 9B. In addition, the various surfaces of can shell 106 are visible, including curved surface 103, fitted indentation 104, semicircular indentation 105, and second curved surface 124.

Held inside the can shell 106 is the slider 207. Visible in the top view, projecting through the channel 703 through the side walls 119 of the can shell 106, the locking flanges 405 and pull tabs 406 allow the first unlocking action. The first unlocking action disengages the locking flanges 405 from contact with the latching surfaces 120 of the safety latch 903.

The true scope the present invention is not limited to the presently preferred or illustrative embodiments disclosed herein. In many cases, the implementation details described herein are a designer's preference and not a hard requirement. Accordingly, except as they may be expressly so limited, the scope of protection of the following claims is not intended to be limited to the specific embodiments described above.

We claim:

1. A bi-fold locking clasp, comprising:

an assembly comprising a retractable spring-loaded slider located on a bottom side of the assembly, the slider comprising at least one locking flange;

a short leaf rotatably connected to the assembly via a first hinge, wherein the first hinge is located on the bottom side of the assembly;

a long leaf rotatably connected to the short leaf via a second hinge, wherein the long leaf comprises a hook configured to removably attach to the first hinge when the bi-fold locking clasp is in a closed position; and a safety latch rotatably connected to the second hinge, wherein the safety latch is configured to rotate down on top of and removably attach to the assembly when the hook is removably attached to the first hinge, and wherein the safety latch inhibits the hook being detached from the first hinge when the safety latch is removably attached to the assembly;

wherein the at least one locking flange is configured to rest on top of a latching surface of the safety latch when the safety latch is removably attached to the assembly, and wherein the at least one locking flange inhibits the safety latch from being detached from the assembly unless the retractable spring-loaded slider is retracted.

2. The bi-fold locking clasp of claim 1, wherein the assembly, the short leaf, the long leaf, and the safety latch are each composed of a durable, corrosion-resistant material.

3. The bi-fold locking clasp of claim 2, wherein the durable, corrosion-resistant material is stainless steel.

4. The bi-fold locking clasp of claim 1, wherein a spring force of the retractable spring-loaded slider is provided by a first spring pin.

5. The bi-fold locking clasp of claim 4, wherein the first spring pin is attached to the retractable spring-loaded slider at one end, and is attached to a pivot bar at the other end.

6. The bi-fold locking clasp of claim 5, wherein the pivot bar is held in place by a second spring pin which is attached to each of two side walls of the assembly, and wherein the first spring pin is perpendicular to and in line with the axis of the second spring pin.

7. The bi-fold locking clasp of claim 1, wherein the retractable spring-loaded slider further comprises two lateral tabs, wherein the two lateral tabs are configured to be grasped in order to retract the retractable spring-loaded slider.

8. The bi-fold locking clasp of claim 7, wherein the two lateral tabs and the safety latch are configured such that a user cannot simultaneously retract the retractable spring-loaded slider and lift the safety latch with one hand.

9. The bi-fold locking clasp of claim 7, wherein the assembly comprises a channel in each of two side walls of the assembly, wherein the at least one locking flange and the two lateral tabs extend outside of the two side walls through the channel.

10. The bi-fold locking clasp of claim 9, wherein the channel is configured to guide the at least one locking flange between a resting position and a retracted position.

11. The bi-fold locking clasp of claim 1, wherein the short leaf comprises a cut out channel which enables the retractable spring-loaded slider to be retracted.

12. A wrist band, comprising:

a band configured to wrap around a wrist of a user, the band including a first end and a second end; and a bi-fold clasp including a first end and a second end, the first end of the band rotatably connected to the first end of the bi-fold clasp, and the second end of the band rotatably connected to the second end of the bid-fold clasp, wherein the bi-fold clasp comprises:

a first locking mechanism, a second locking mechanism, wherein the second locking mechanism inhibits unlocking of the first locking mechanism, and wherein the second locking mechanism comprises a safety latch and at least one of the group consisting of:

an assembly, wherein the safety latch and the assembly comprise mating friction elements for removably attaching the safety latch to the assembly, and a retractable slider, wherein the retractable slider rests above a surface of the safety latch when the safety latch is in a locked position, and wherein the retractable slider inhibits the safety latch from being lifted, and a third locking mechanism, wherein the third locking mechanism inhibits unlocking of the second locking mechanism.

13. The wrist band of claim 12, further comprising a device located on the band.

14. The wrist band of claim 13, wherein the device is a watch.

15. The wrist band of claim 13, wherein the device is further configured to determine the location of the device.

16. The wrist band of claim 15, wherein the device is configured to transmit the location of the device to a remote server.

17. The wristband of claim 12, wherein the first locking mechanism comprises a hook and a friction element.

* * * * *